US005732610A

United States Patent [19]

Halladay et al.

[11] Patent Number: 5,732,610

[45] Date of Patent: Mar. 31, 1998

[54] AUTOMATIC PROTECTIVE BAGEL SLICING SYSTEM

[76] Inventors: Gordon Halladay; William Joseph, both of 6 Hermann St., West Carteret, N.J. 07008

[21] Appl. No.: 767,207

[22] Filed: Dec. 16, 1996

[51] Int. Cl.[6] ..... B26D 1/46; B26D 3/30

[52] U.S. Cl. ..... 83/871; 83/874; 83/435.15; 83/437.2; 83/788; 83/860; 83/932

[58] Field of Search ..... 83/870, 871, 872, 83/874, 435.11, 435.15, 437.1, 437.2, 651.1, 788, 860, 932

[56] References Cited

U.S. PATENT DOCUMENTS

| | | | |
|---|---|---|---|
| D. 264,720 | 6/1982 | Fuse . | |
| 1,005,128 | 10/1911 | Blain | 83/437.2 |
| 1,438,870 | 12/1922 | Smith | 83/437.2 |
| 2,009,913 | 7/1935 | Bever | 83/874 |
| 2,279,376 | 4/1942 | Marriott | 83/874 |
| 2,444,704 | 7/1948 | Keefer | 83/437.2 |
| 2,497,187 | 2/1950 | Sammy | 83/872 |
| 2,685,901 | 8/1954 | Putzer | 83/870 |
| 4,077,685 | 3/1978 | Scire et al. . | |
| 4,230,007 | 10/1980 | Grote et al. | 83/871 |
| 4,280,385 | 7/1981 | Kienzl | 83/435.15 X |
| 4,546,686 | 10/1985 | Losiowski et al. | 83/874 |
| 4,774,880 | 10/1988 | Nelson . | |
| 5,115,704 | 5/1992 | Hyman | 83/467.1 |
| 5,163,628 | 11/1992 | Arnold . | |
| 5,431,078 | 7/1995 | Ricard et al. | 83/870 |

*Primary Examiner*—Eugenia Jones

[57] ABSTRACT

An automatic protective bagel slicing system for automatically slicing food, such as bagels or rolls, into symmetric halves within an enclosed drawer for precluding injury to a user. The inventive device includes an encasement having an interior cavity, a drawer slidably projecting into the encasement, a loop blade rotatably connected mesial a motor and a pulley traverse to the drawer's line of motion, and a slot within the drawer to receive the blade. An outer track is secured to a bottom surface of the drawer and an inner track is secured to a bottom surface of the interior cavity for slidably engaging the outer track. The food to be sliced is positioned within the drawer and the drawer is pushed into the encasement where the blade cuts the food into symmetrical halves.

8 Claims, 3 Drawing Sheets

AUTOMATIC PROTECTIVE BAGEL SLICING SYSTEM

BACKGROUND OF THE INVENTION

1. Field of the Invention

The present invention relates to Bagel Slicing Devices and more particularly pertains to a new Automatic Protective Bagel Slicing System for automatically slicing food, such as bagels or rolls, into symmetric halves within an enclosed drawer for precluding injury to a user.

2. Description of the Prior Art

The use of Bagel Slicing Devices is known in the prior art. More specifically, Bagel Slicing Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art slicing devices include U.S. Pat. No. 5,115,704; U.S. Pat. No. 5,163,628; U.S. Design Pat. 264,720; U.S. Pat. No. 4,774,880 and U.S. Pat. No. 4,077,685.

While these devices fulfill their respective, particular objectives and requirements, the aforementioned patents do not disclose a new Automatic Protective Bagel Slicing System. The inventive device includes an encasement having an interior cavity, a drawer slidably projecting into the encasement, a loop blade rotatably connected mesial a motor and a pulley traverse to the drawer's line of motion, and a slot within the drawer to receive the blade.

In these respects, the Automatic Protective Bagel Slicing System according to the present invention substantially departs from the conventional concepts and designs of the prior art, and in so doing provides an apparatus primarily developed for the purpose of automatically slicing food, such as bagels or rolls, into symmetric halves within an enclosed drawer for precluding injury to a user.

SUMMARY OF THE INVENTION

In view of the foregoing disadvantages inherent in the known types of Bagel Slicing Devices now present in the prior art, the present invention provides a new Automatic Protective Bagel Slicing System construction wherein the same can be utilized for automatically slicing food, such as bagels or rolls, into symmetric halves within an enclosed drawer for precluding injury to a user.

The general purpose of the present invention, which will be described subsequently in greater detail, is to provide a new Automatic Protective Bagel Slicing System apparatus and method which has many of the advantages of the Bagel Slicing Devices mentioned heretofore and many novel features that result in a new Automatic Protective Bagel Slicing System which is not anticipated, rendered obvious, suggested, or even implied by any of the prior art Bagel Slicing Devices, either alone or in any combination thereof.

To attain this, the present invention generally comprises an encasement having an interior cavity, a drawer slidably projecting into the encasement, a loop blade rotatably connected mesial a motor and a pulley traverse to the drawer's line of motion, and a slot within the drawer to receive the blade.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Automatic Protective Bagel Slicing System apparatus and method which has many of the advantages of the Bagel Slicing Devices mentioned heretofore and many novel features that result in a new Automatic Protective Bagel Slicing System which is not anticipated, rendered obvious, suggested, or even implied by any of the prior art Bagel Slicing Devices, either alone or in any combination thereof.

It is another object of the present invention to provide a new Automatic Protective Bagel Slicing System which may be easily and efficiently manufactured and marketed.

It is a further object of the present invention to provide a new Automatic Protective Bagel Slicing System which is of a durable and reliable construction.

An even further object of the present invention is to provide a new Automatic Protective Bagel Slicing System which is susceptible of a low cost of manufacture with regard to both materials and labor, and which accordingly is then susceptible of low prices of sale to the consuming public, thereby making such Automatic Protective Bagel Slicing System economically available to the buying public.

Still yet another object of the present invention is to provide a new Automatic Protective Bagel Slicing System which provides in the apparatuses and methods of the prior art some of the advantages thereof, while simultaneously overcoming some of the disadvantages normally associated therewith.

Still another object of the present invention is to provide a new Automatic Protective Bagel Slicing System for automatically slicing food, such as bagels or rolls, into symmetric halves within an enclosed drawer for precluding injury to a user.

Yet another object of the present invention is to provide a new Automatic Protective Bagel Slicing System which includes an encasement having an interior cavity, a drawer slidably projecting into the encasement, a loop blade rotatably connected mesial a motor and a pulley traverse to the drawer's line of motion, and a slot within the drawer to receive the blade.

Still yet another object of the present invention is to provide a new Automatic Protective Bagel Slicing System that reduces the labor involved in slicing food such as bagels and reduces the chances of injuries.

Even still another object of the present invention is to provide a new Automatic Protective Bagel Slicing System that provides a convenient and fast method of cutting a bagel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
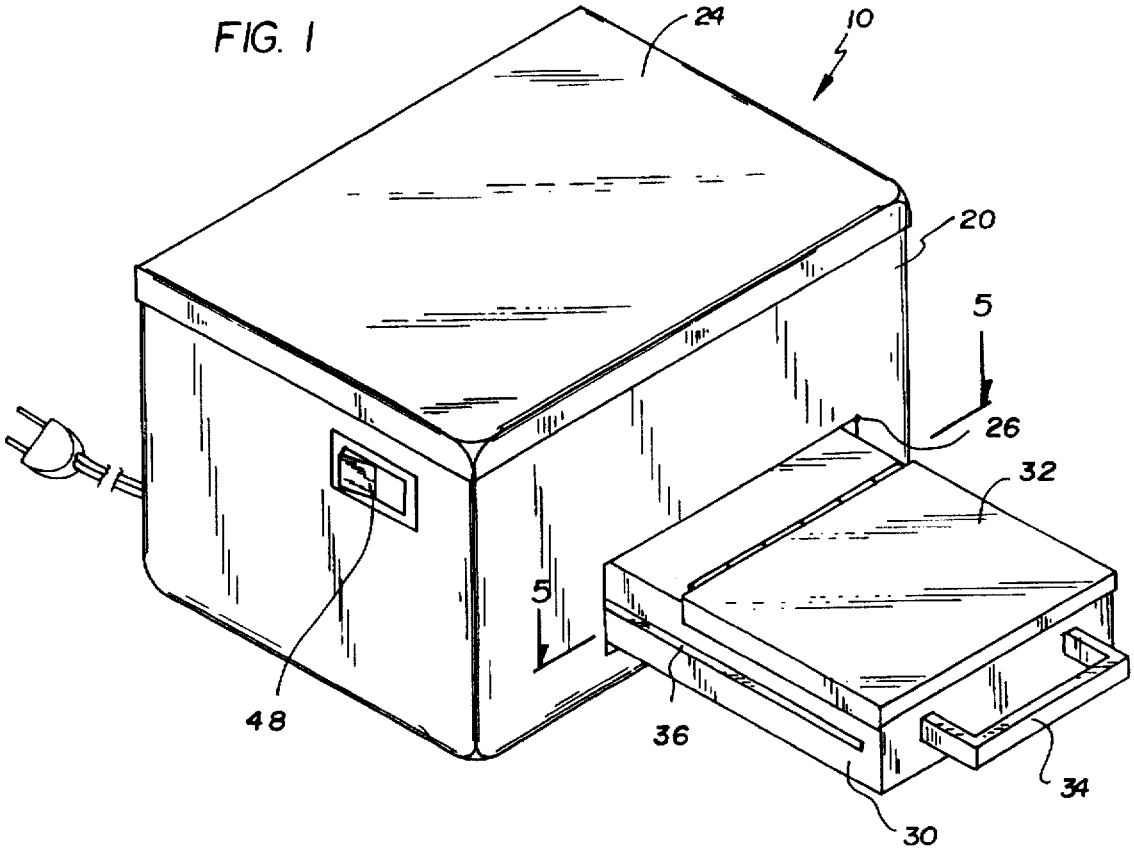
FIG. 1 is an upper perspective view of a new Automatic Protective Bagel Slicing System according to the present invention.
Figure 2:
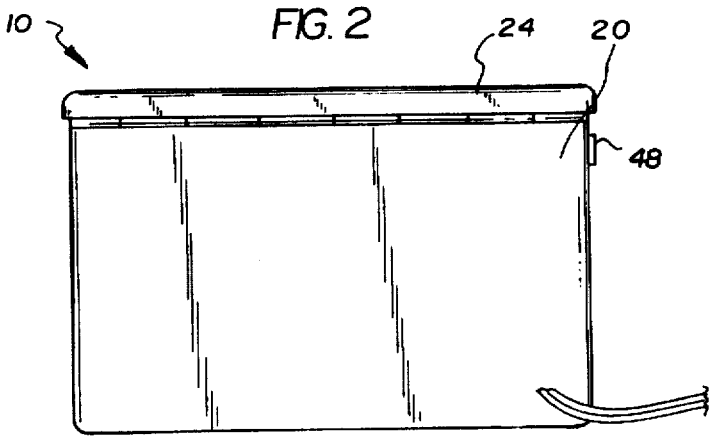
FIG. 2 is a rear view of the present invention.

With reference now to the drawings, and in particular to FIGS. 1 through 6 thereof, a new Automatic Protective Bagel Slicing System embodying the principles and concepts of the present invention and generally designated by the reference numeral 10 will be described.

More specifically, it will be noted that the Automatic Protective Bagel Slicing System 10 comprises an encasement 20 having an interior cavity 22 and an opening 26 into a side. The encasement 20 preferably includes a lid 24 pivotally secured for allowing access to the cutting means 40. A drawer 30 slidably projects into the opening 26 of the encasement 20 for removably receiving food 12, such as a bagel or roll, to be cut. A cutting means 40 is secured within the interior cavity 22 of the encasement 20 for cutting the food 12 within the drawer 30 into symmetrical halves when the drawer 30 is pushed into the interior cavity 22 as shown in FIG. 5 of the drawings.

Figure 3:
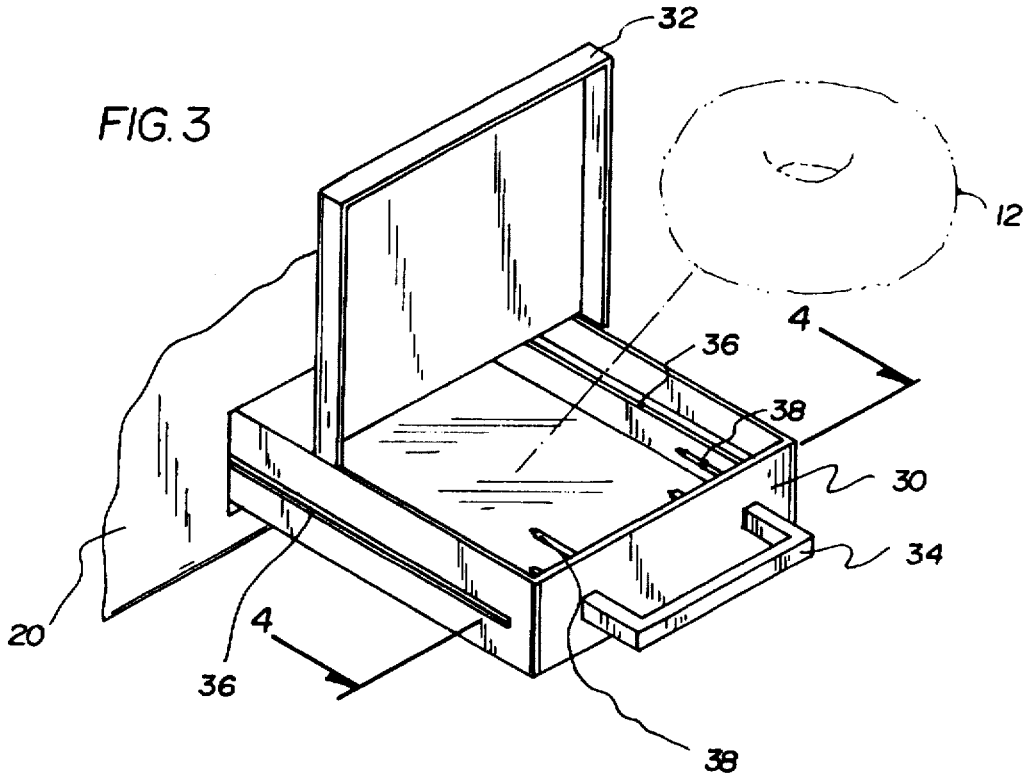
FIG. 3 is a magnified upper perspective view of the present invention disclosing the drawer.
Figure 4:
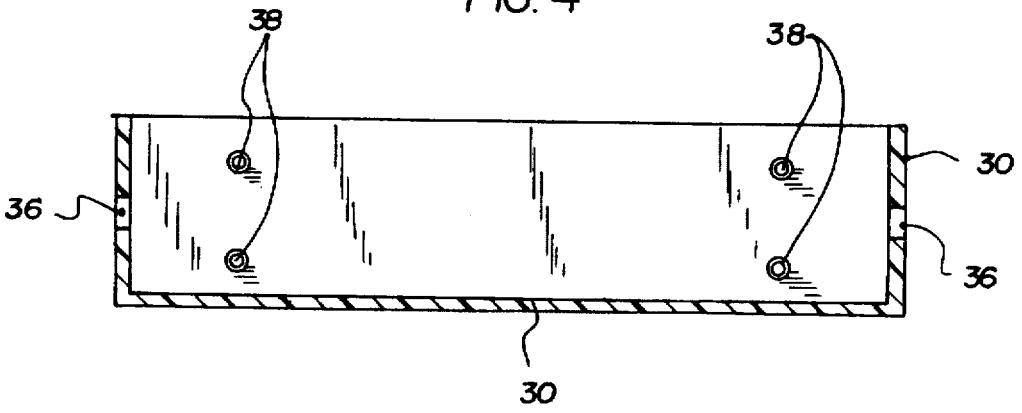
FIG. 4 is a cross sectional view taken along line 4—4 of FIG. 3.
Figure 5:
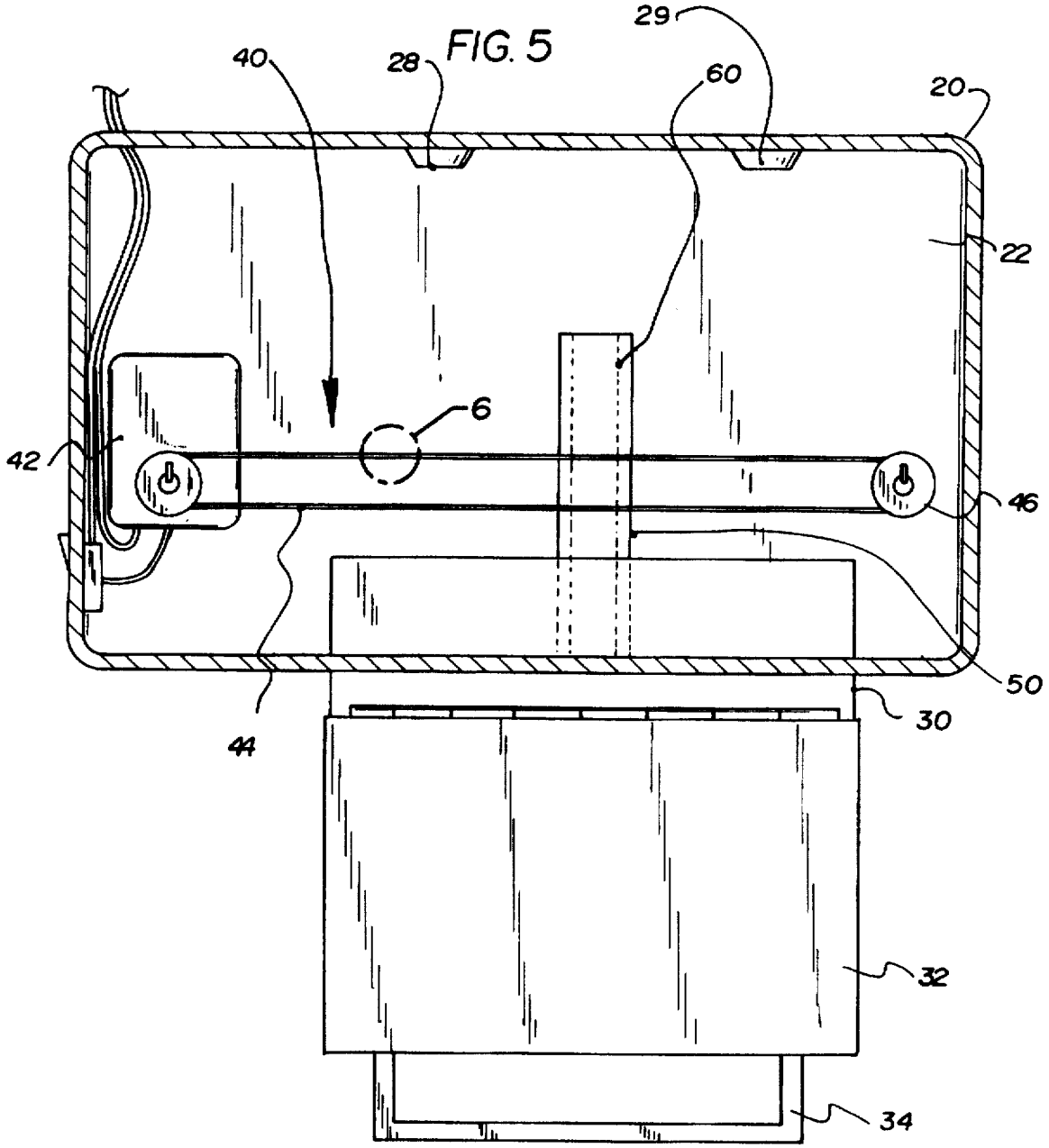
FIG. 5 is a cross sectional view taken along line 5—5 of FIG. 1.
Figure 6:
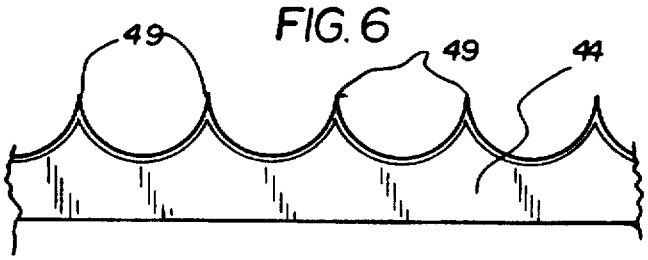
FIG. 6 is a magnified top view of the loop blade.

As best shown in FIGS. 5 and 6 of the cutting means 40 comprises a motor 42 secured within the interior cavity 22 of the encasement 20. A switch 48 is electrically coupled to the motor 42 for controlling the motor 42. The switch 48 is also secured to an exterior surface of the encasement 20. A loop blade 44 rotatably engages the motor 42. The loop blade 44 is for cutting the food 12 within the drawer 30. A pulley 46 is rotatably secured within the interior cavity 22 of the encasement 20 opposite of the motor 42. The pulley 46 rotatably engages the loop blade 44 opposite of the motor 42 for rotating the loop blade 44 traversely to the drawer 30. The loop blade 44 forms a plane as shown in FIG. 5 of the drawings. The loop blade 44 preferably has a plurality of teeth 49 as best shown in FIG. 6 of the drawings. A slot 36 projects within the drawer 30 along the plane for receiving the loop blade 44 during cutting of the food 12 within the drawer 30 as best shown in FIGS. 3 and 4 of the drawings. A plurality of spikes 38 are preferably secured within the drawer 30 opposite of the loop blade 44 and projecting substantially parallel to the plane as best shown in FIGS. 3 and 4 of the drawings.

As shown in FIG. 5 of the drawings, an inner track 60 is secured to the interior cavity 22 of the encasement 20 traverses to the loop blade 44. An outer 50 is secured to a bottom surface of the drawer 30. The outer track 50 slidably engages the inner track 60 for sliding the drawer 30 upon. Preferably, as shown in FIGS. 1, 3 and 5 of the drawings, a cover 32 is pivotally secured to the drawer 30 substantially concentric for allowing selective positioning of the food 12 within the drawer 30. The cover 32 is also for selectively covering the food 12 during cutting of the food 12 and for preventing the user from inserting a body part into the cutting means 40. As shown in FIGS. 1, 3 and 5 of the drawings, a handle 34 is secured to an exterior surface of the drawer 30. Preferably, as shown in FIG. 5 of the drawings, at least one stopper 28 is secured within the interior cavity 22 of the encasement 20 opposite of the opening 26 for engaging the drawer 30 opposite of the handle 34 during cutting of the food 12.

In use, the user pulls the drawer 30 out from within the encasement 20. The user opens the cover 32 and positions food 12 into the drawer 30 to be cut into halves. The cover 32 is closed and the switch 48 is closed thereby activating the motor 42 which rotates the loop blade 44. The user thereafter pushes the drawer 30 into the encasement 20 whereby the loop blade 44 passes freely through the slot 36. While the drawer 30 is positioned within the encasement 20, the cover 32 can not be opened thereby preventing injuries to the user during operation of the present invention. The loop blade 44 thereby cuts through the food 12 until the drawer 30 engages the stoppers 28. The drawer 30 is then pulled out and the switch 48 is opened thereby deactivating the motor 42. The cover 32 is opened allowing the user to remove the symmetrical halves of the food 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An automatic protective bagel slicing system comprising an encasement having an interior cavity and an opening in a side of said encasement;

a drawer slidably projecting into said opening of said encasement for removably receiving food to be cut; and a cutting means secured within said interior cavity of said encasement for cutting said food within said drawer into symmetrical halves when said drawer is pushed into said interior cavity;

wherein said cutting means comprises:

a motor secured within said interior cavity of said encasement;

a loop blade rotatably engaging said motor, wherein said loop blade is for cutting said food;

a pulley rotatably secured within said interior cavity of said encasement and rotatably engaging said loop blade for rotating said loop blade in a transverse orientation to said drawer, wherein said loop blade is planar; and a slot positioned within said drawer along said plane for receiving said loop blade during cutting of said food within said drawer.

2. The automatic protective bagel slicing system of claim 1 including a plurality of spikes secured within said drawer and projecting substantially parallel to said plane.

3. The automatic protective bagel slicing system of claim 1 including:

an inner track secured to said interior cavity of said encasement transverse to said loop blade; and an outer track secured to a bottom surface of said drawer and slidably engaging said inner track.

4. The automatic protective bagel slicing system of claim 1 including a cover pivotally secured to said drawer for allowing selective covering of said food during cutting of said food.

5. The automatic protective bagel slicing system of claim 1 including a handle secured to an exterior surface of said drawer.

6. The automatic protective bagel slicing system of claim 1 including at least one stopper secured within said interior cavity of said encasement for engaging said drawer during cutting of said food.

7. The automatic protective bagel slicing system of claim 1 wherein said encasement includes a lid for allowing access to said cutting means.

8. The automatic protective bagel slicing system of claim 1 including a switch electrically coupled to said motor for controlling said motor, wherein said switch is secured to an exterior surface of said encasement.

* * * * *